US008141976B2

(12) United States Patent
Motoyama et al.

(10) Patent No.: US 8,141,976 B2
(45) Date of Patent: Mar. 27, 2012

(54) PRINTING CONTROL METHOD FOR A SERIAL INKJET PRINTER, AND A SERIAL INKJET PRINTER

(75) Inventors: Hiroyuki Motoyama, Matsumoto (JP); Minoru Nagaoka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 421 days.

(21) Appl. No.: 12/387,881

(22) Filed: May 8, 2009

(65) Prior Publication Data

US 2009/0278873 A1 Nov. 12, 2009

(30) Foreign Application Priority Data

May 8, 2008 (JP) ..... 2008-121933

(51) Int. Cl.
*B41J 29/393* (2006.01)
*B41J 29/38* (2006.01)
*B41J 2/165* (2006.01)

(52) U.S. Cl. ..... 347/19; 347/5; 347/6; 347/14; 347/20; 347/22; 347/34; 347/101; 347/104

(58) Field of Classification Search ..... 347/14, 347/19, 34
See application file for complete search history.

(56) References Cited

U.S. PATENT DOCUMENTS

| | | | | |
|---|---|---|---|---|
| 5,838,354 | A * | 11/1998 | Yamada et al. | 347/101 |
| 6,042,228 | A * | 3/2000 | Yamada et al. | 347/104 |
| 6,457,803 | B1 * | 10/2002 | Ohkoda | 347/36 |
| 2002/0130910 | A1 * | 9/2002 | Otsuki | 347/5 |
| 2004/0169711 | A1 * | 9/2004 | Tsuji et al. | 347/104 |
| 2007/0146456 | A1 | 6/2007 | Tanabe | |
| 2008/0265496 | A1 * | 10/2008 | Kawaguchi et al. | 271/227 |

FOREIGN PATENT DOCUMENTS

| | | |
|---|---|---|
| JP | 2001-239712 | 9/2001 |
| JP | 2006-248040 | 9/2006 |
| JP | 2007-168387 | 7/2007 |

* cited by examiner

*Primary Examiner* — Ryan Lepisto
(74) *Attorney, Agent, or Firm* — Nutter McClennen & Fish LLP; John J. Penny, Jr.; Derek P. Roller

(57) ABSTRACT

A printing control method for a serial inkjet printer prevents paper dust that is dispersed by the air current produced by a vacuum platen from adhering to the ink nozzle area. An inkjet head that prints while moving along the width of the vacuum platen is moved to a position where the ink nozzle area is outside of a first or second retraction position separated a first distance from the first and second paper edge positions of the recording paper, and the recording paper is then advanced. Paper dust and other dust particulate does not adhere to the ink nozzle area when the paper is advanced because the ink nozzle area does not stop in the first and second paper edge positions of the recording paper where paper dust and other dust particulate can be made airborne by the air current produced by the vacuum platen.

13 Claims, 8 Drawing Sheets

PRINTING CONTROL METHOD FOR A SERIAL INKJET PRINTER, AND A SERIAL INKJET PRINTER

CROSS REFERENCE TO RELATED APPLICATION

Priority is claimed under 35 U.S.C. §119 to Japanese Patent application No. 2008-121933, filed May 8, 2008, which is hereby incorporated by reference in its entirety.

BACKGROUND

1. Field of Invention

The present invention relates to a serial inkjet printer that has a vacuum platen for pulling the paper thereto while the recording paper is conveyed over the platen. More particularly, the invention relates to a serial inkjet printer and a printing control method for a serial inkjet printer that prevents paper dust that is propelled and made airborne by the air current produced by the vacuum action of the vacuum platen when conveying the recording paper from clinging to the ink nozzle area of the inkjet head.

2. Description of Related Art

Some inkjet printers that print to recording paper conveyed passed the printing position have a vacuum platen to prevent the recording paper from lifting away from the platen at the printing position so that the recording paper does not interfere with the inkjet head. A suction area having numerous vacuum holes is formed in the vacuum platen surface, and the recording paper conveyed over the platen surface is pulled to the platen surface by sucking air through these holes. A serial inkjet printer with such a vacuum platen is taught in Japanese Unexamined Patent Appl. Pub. JP-A-2006-248040, for example.

In order to print, this type of serial inkjet printer repeats the operations of printing to the recording paper while moving the inkjet head widthwise to the vacuum platen, and advancing the recording paper a specific pitch in the direction perpendicular to the width of the vacuum platen. This means that in order to print to the full width of the recording paper, the paper is advanced when the inkjet head is stopped near the right or left edge of the paper.

When the width of the recording paper is less than the suction area of the vacuum platen, part of the suction area is exposed outside the edges of the recording paper, and an air stream is produced around the edges of the paper by the suction of air in this exposed area. This air stream dispels chaff and dust, for example, above the edges of the recording paper.

As a result, when printing to the full width of recording paper that is narrower than the suction area of the vacuum platen, the inkjet head stops at the paper edge where chaff and dust is easily dispersed into the air. Because the paper is advanced when the inkjet head is stopped at the paper edge, the likelihood of paper dust and other dust particulate that is conveyed with the recording paper being dispersed into the air and then clinging to the ink nozzle area of the inkjet head increases. When such chaff and dust clings to the ink nozzle area of the print head, the ink nozzles can become clogged such that the ink droplets are not discharged correctly, and printing defects, such as content not being printed because ink is not discharged, can result.

SUMMARY OF THE INVENTION

A serial inkjet printer and a printing control method for a serial inkjet printer according to the present invention prevent paper dust and other dust particulate that is propelled and made airborne by the air current produced by the vacuum platen when the recording paper is conveyed from adhering to the ink nozzle area of the inkjet head.

A first aspect of the invention is a printing control method for a serial inkjet printer, including a printing step of printing to a recording medium while moving an inkjet head widthwise to a vacuum platen that has a vacuum area for pulling the recording medium thereto; a head retracting step of moving the inkjet head so that the ink nozzle area of the inkjet head is positioned to a first retraction position or second retraction position respectively separated a first distance to the outside of the recording medium from a first edge part or second edge part of the recording medium widthwise to the vacuum platen; and a recording medium transportation step that conveys the recording medium in a direction perpendicular to the width of the vacuum platen.

In this aspect of the invention the inkjet head that prints to the recording medium while moving along the width of the vacuum platen is moved so that the ink nozzle area is positioned to a first retraction position or second retraction position separated a first distance from the corresponding edge of the recording medium. The recording medium is then advanced after the inkjet head is moved. As a result, because the ink nozzle area of the inkjet head does not stop at the first edge part or second edge part of the recording medium, clinging of paper dust and other dust particulate to the ink nozzle area can be suppressed or prevented even when such paper dust and other dust particulate is easily dispersed into the air by the air current produced near the paper edges by the suction of the vacuum platen. Furthermore, because the ink nozzle area is moved to a position separated from the edges of the recording medium when the recording medium is conveyed, clinging of paper dust and other dust particulate to the ink nozzle area can be suppressed or prevented even when such paper dust and other dust particulate that is delivered with the recording medium is dispersed into the air.

In order to prevent the ink nozzle area from being affected by air currents produced by the vacuum action, the first retraction position and second retraction position can be set to positions separated at least a first distance to the outside of the vacuum area of the vacuum platen, or based on the maximum width of the recording medium used for printing, but in order to shorten the distance the inkjet head moves, the printing control method preferably has a retraction position setting step of setting the first retraction position and second retraction position based on the width of the recording medium widthwise to the vacuum platen.

In order to simplify drive control for retracting the inkjet head, the head retracting step in another aspect of the invention moves the inkjet head to the side of the first retraction position or second retraction position that is positioned in the direction the inkjet head was moving in the printing step.

The printing control method for a serial inkjet printer according to another aspect of the invention preferably also has a recording medium edge position acquisition step of acquiring the positions of the first edge part and second edge part of the recording medium widthwise to the vacuum platen before the printing step based on the width of the recording medium, and a head position determination step of acquiring the end-of-printing position where the inkjet head is positioned widthwise to the vacuum platen after the printing step, and determining if the ink nozzle area of the inkjet head in the end-of-printing position is separated a second distance or more to the inside of the recording medium from the first edge part and second edge part, and the head retracting step holds without moving the inkjet head at the end-of-printing position if the ink nozzle area is separated the second distance or more to the inside of the recording medium from the first edge part or second edge part.

More specifically, if the ink nozzle area of the inkjet head at the end-of-printing position is at a position somewhere inside the recording medium separated at least a second distance to the inside of the recording medium from the first edge part and second edge part, the inkjet head is not moved and is held at the end-of-printing position, thereby suppressing or avoiding the dispersion of paper dust and other dust particulate to the ink nozzle area. The printing time can also be shortened because it is not necessary to move the inkjet head.

Because the entire width of the vacuum area is covered by the recording medium when the width of the recording medium used for printing is greater than or equal to the vacuum area of the vacuum platen in this aspect of the invention, an air current caused by the suction of the vacuum platen is not produced near the edges of the recording medium. In order to shorten the printing time, the printing control method preferably has a paper width determination step of determining if the width of the recording medium is greater than or equal to the width of the vacuum area widthwise to the vacuum platen, and executes only the printing step and recording medium transportation step when the width of the recording medium is greater than or equal to the width of the vacuum area.

In order to acquire the width of the recording medium, the printing control method according to another aspect of the invention preferably also has a recording medium width acquisition step of receiving a control command for printing from an external device, and acquiring the width of the recording medium contained in the control command.

In order to acquire the width of the recording medium, the printing control method according to another aspect of the invention has a recording medium width acquisition step of acquiring the width of the recording medium by means of a paper width detector.

Another aspect of the invention is a serial inkjet printer having a vacuum platen that has a vacuum area for pulling a recording medium thereto; an inkjet head that is disposed movably widthwise to the vacuum platen for printing to the recording medium; and a control unit that after printing by the inkjet head ends moves the inkjet head so that the ink nozzle area of the inkjet head is positioned to a first retraction position or second retraction position respectively separated a first distance to the outside of the recording medium from a first edge part or second edge part of the recording medium widthwise to the vacuum platen, and after moving the inkjet head, controls conveying the recording medium in a direction perpendicular to the width of the vacuum platen.

In this aspect of the invention the inkjet head that prints to the recording medium while moving along the width of the vacuum platen is moved so that the ink nozzle area is positioned to a first retraction position or second retraction position separated a first distance from the edge of the recording medium. The recording medium is then advanced after the inkjet head is moved. As a result, because the ink nozzle area of the inkjet head does not stop at the first edge part or second edge part of the recording medium, clinging of paper dust and other dust particulate to the ink nozzle area can be suppressed or prevented even when such paper dust and other dust particulate is easily dispersed into the air by the air current produced near the edges of the recording medium by the suction of the vacuum platen. Furthermore, because the ink nozzle area is moved to a position separated from the edges of the recording medium when the recording medium is conveyed, clinging of paper dust and other dust particulate to the ink nozzle area can be suppressed or prevented even when such paper dust and other dust particulate that is delivered with the recording medium is dispersed into the air.

In order to prevent the ink nozzle area from being affected by air currents produced by the vacuum action, the first retraction position and second retraction position can be set to positions separated at least a first distance to the outside of the vacuum area of the vacuum platen, or based on the maximum width of the recording medium used for printing, but in order to shorten the distance the inkjet head moves, the printing control method preferably has a retraction position setting unit that sets the first retraction position and second retraction position based on the width of the recording medium widthwise to the vacuum platen.

In order to simplify drive control for retracting the inkjet head, the control unit in another aspect of the invention moves the inkjet head to the side of the first retraction position or second retraction position that is positioned in the direction the inkjet head was moving while printing.

A serial inkjet printer according to another preferred aspect of the invention also has a recording medium edge position acquisition unit that acquires the positions of the first edge part and second edge part of the recording medium in the direction across the width to the vacuum platen based on the width of the recording medium, and a head position determination means that acquires the end-of-printing position where the inkjet head is positioned widthwise to the vacuum platen when printing by the printing means ends. When the ink nozzle area is separated the second distance or more to the inside of the recording medium from the first edge part or second edge part, the head retracting means preferably does not move the inkjet head and holds at the end-of-printing position.

More specifically, if the ink nozzle area of the inkjet head at the end-of-printing position is at a position separated at least a second distance to the inside of the recording medium from the first edge part and second edge part, the inkjet head is not moved and is held at the end-of-printing position, thereby suppressing or avoiding the dispersion of paper dust and other dust particulate to the ink nozzle area. The printing time can also be shortened because it is not necessary to move the inkjet head.

Because the entire width of the vacuum area is covered by the recording medium when the width of the recording medium used for printing is greater than or equal to the vacuum area of the vacuum platen in this aspect of the invention, an air current caused by the suction of the vacuum platen is not produced near the edges of the recording medium. In order to shorten the printing time, the serial inkjet printer preferably has a recording medium width determination unit that determines if the width of the recording medium is greater than or equal to the width of the vacuum area along the width of the vacuum platen, and the head retraction control unit does not move the inkjet head if the width of the recording medium is greater than or equal to the width of the vacuum area.

In order to acquire the width of the recording medium, the serial inkjet printer according to another aspect of the invention preferably also has a recording medium width acquisition unit that receives a control command from an external device, and acquires the width of the recording medium contained in the control command.

In order to acquire the width of the recording medium, the serial inkjet printer according to another aspect of the invention preferably has a recording medium width detector that acquires the width of the recording medium.

Effect of the Invention

The inkjet head that prints to the recording medium while moving along the width of the vacuum platen is moved so that the ink nozzle area is positioned to a first retraction position or second retraction position separated a first distance from the edge of the recording medium. The recording medium is then advanced after the inkjet head is moved to the retracted position. As a result, because the ink nozzle area of the inkjet head does not stop at the first edge part or second edge part of the recording medium, clinging of paper dust and other dust particulate to the ink nozzle area can be suppressed or prevented even when such paper dust and other dust particulate is easily dispersed into the air by the air current produced near the edges of the recording medium by the suction of the vacuum platen. Furthermore, because the ink nozzle area is moved to a position separated from the edges of the recording medium when the recording medium is conveyed, clinging of paper dust and other dust particulate to the ink nozzle area can be suppressed or prevented even when such paper dust and other dust particulate that is delivered with the recording medium is dispersed into the air. As a result, print defects, including content not printing, can be avoided because ink droplets are not prevented from being discharged normally as a result of ink nozzles becoming clogged by paper dust or other particulate dust.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 5 is a plan view of the vacuum platen when the recording paper passes by.

DESCRIPTION OF PREFERRED EMBODIMENTS

A printer according to a preferred embodiment of the present invention is described below with reference to the accompanying figures.

Figure 1:
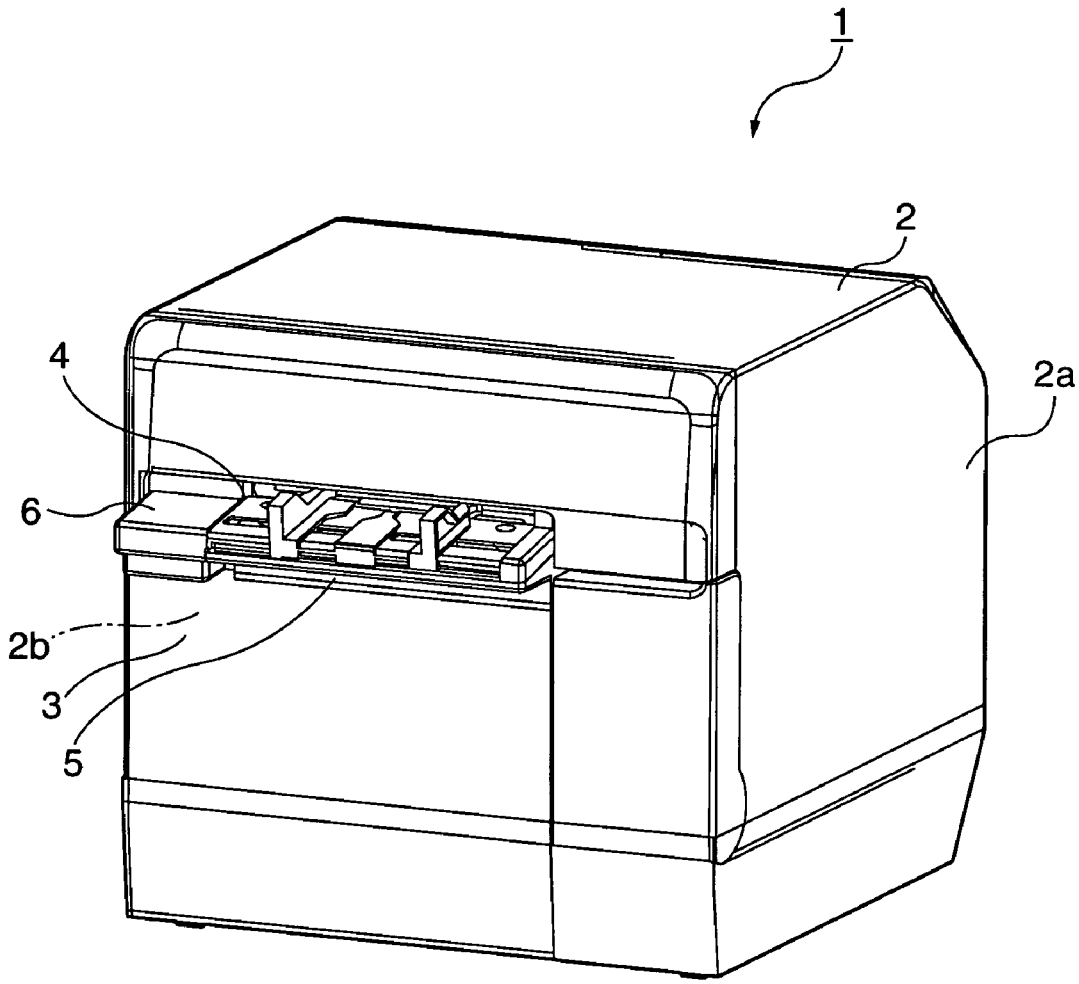
FIG. 1 is an external oblique view of a roll paper printer according to a preferred embodiment of the invention.
Figure 2:
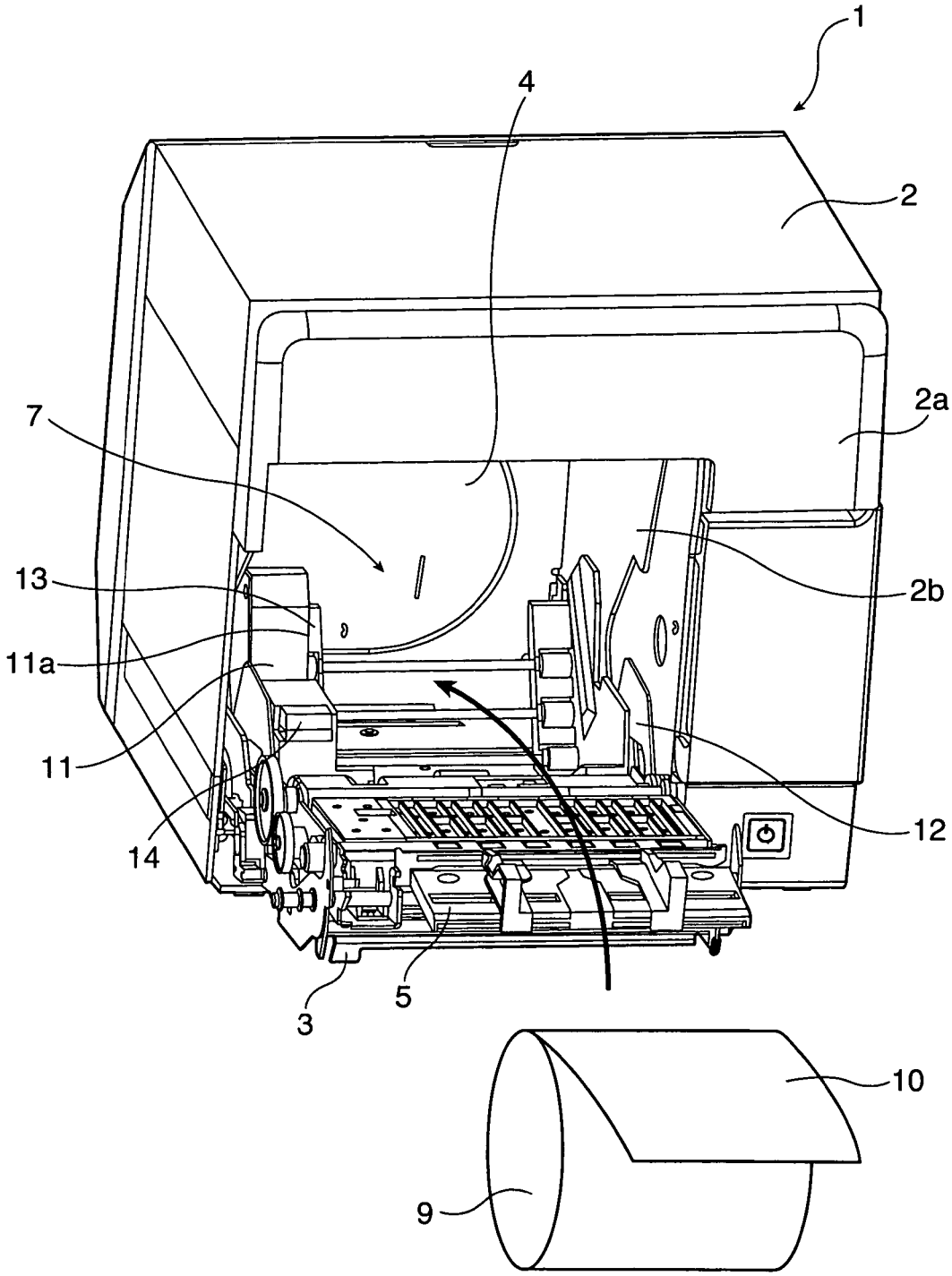
FIG. 2 is an external oblique view of the roll paper printer with the access cover open.

FIG. 1 is an oblique view showing a roll paper printer according to a first embodiment of the invention. FIG. 2 is an oblique view of the same printer with the access cover open.

The roll paper printer 1 has a rectangular box-like case 2 and a cover 3 that opens and closes and is disposed to the front of the case 2. A paper exit 4 of a specific width is formed at the front of the outside case 2*a* part of the printer case 2. An exit guide 5 projects to the front from the bottom of the paper exit 4, and a cover opening lever 6 is disposed beside the exit guide 5. A rectangular opening 2*b* for loading and removing roll paper, which is a recording medium or recording paper, is formed in the outside case 2*a* below the exit guide 5 and cover opening lever 6, and this opening 2*b* is closed by the cover 3.

Operating the cover opening lever 6 unlocks the cover 3. When the exit guide 5 is pulled forward, the cover 3 pivots at the bottom end part thereof and opens forward to a substantially horizontal position. As shown in FIG. 2, when the cover 3 opens, the roll paper compartment 7 formed inside the printer case 2 opens. The vacuum platen 8 that defines the printing position moves simultaneously with the access cover 3, and the recording paper transportation path from the roll paper compartment 7 to the paper exit 4 is opened, enabling replacing the roll paper 9 from the front of the printer case 2.

The roll paper 9 is placed horizontally on its side inside the roll paper compartment 7. The roll paper compartment 7 has a left and right first side wall 11 and second side wall 12 that determine the storage width of the compartment, and the first side wall 11 and second side wall 12 can slide widthwise to the printer to store roll paper 9 of different widths. A roll paper urging member 13 and a locking mechanism for locking the first side wall 11 so that it cannot move sideways are disposed in the first side wall 11, and the operating part 14 of the locking mechanism is exposed at the front top edge part of the first side wall 11. The distal end part of the roll paper urging member 13 protrudes to the inside of the roll paper compartment 7 from a window formed in the inside surface 11*a* of the first side wall 11. The roll paper urging member 13 can move between the protruding position shown in FIG. 2, and a retracted position where the surface of its distal end part is flush with the surface 11*a* of the first side wall 11, and is constantly urged with a specific urging force toward the protruding position.

The lock is released when the locking mechanism operating part 14 is manually depressed, thereby enabling moving and positioning the first side wall 11 widthwise to the printer according to the width of the stored roll paper 9. When the locking mechanism operating part 14 is then released from the depressed position, the lock re-engages and prevents moving the first side wall 11. When the roll paper 9 is stored after adjusting the storage width of the roll paper compartment, the roll paper urging member 13 pushes the roll paper 9 toward the second side wall 12 side so that there is no play in the stored roll paper 9. Note that the open/close detector 3*a* of the access cover 3 and the cover opening lever 6 are not shown in FIG. 2.

Figure 3:
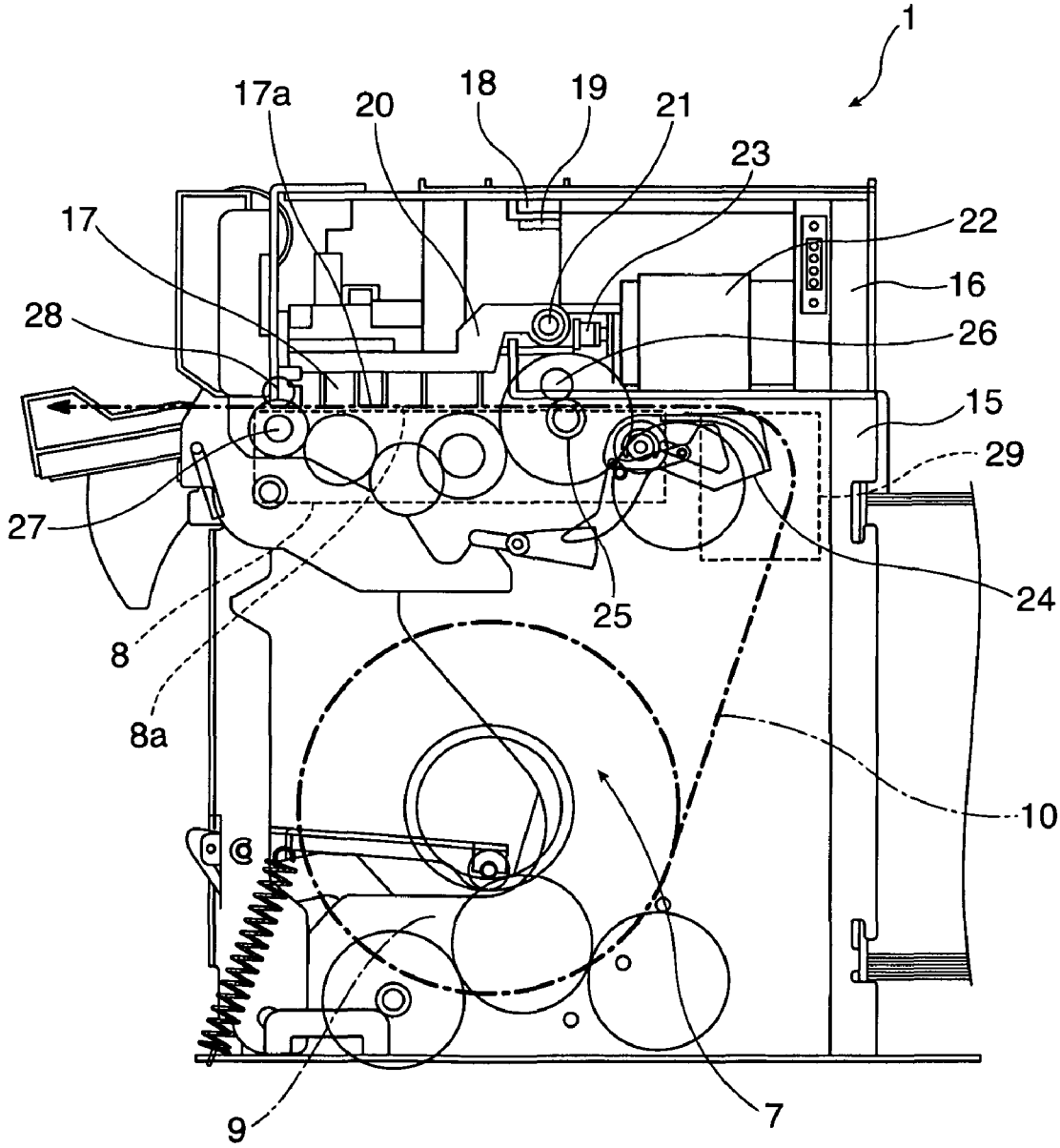
FIG. 3 is a vertical section view showing the internal structure of the roll paper printer.

FIG. 3 shows the internal configuration of the roll paper printer 1. The roll paper compartment 7 is formed in the middle between the sides of the printer frame 15 inside the roll paper printer 1.

A head unit frame 16 is disposed horizontally at the top of the printer frame 15 above the roll paper compartment 7. Disposed to the head unit frame 16 are an inkjet head 17, a linear scale 18 and an encoder sensor 19 for detecting the position of the inkjet head 17, a carriage 20 that carries the inkjet head 17 and the encoder sensor 19, and a carriage guide shaft 21 that guides movement of the carriage 20 widthwise to the printer.

The inkjet head 17 is mounted on the carriage 20 with the ink nozzle area 17*a* facing down. The carriage guide shaft 21 is disposed horizontally widthwise to the printer. A carriage transportation mechanism including a carriage motor 22 and timing belt 23 for conveying the carriage 20 bidirectionally along the carriage guide shaft 21 is disposed to the head unit frame 16.

A vacuum platen 8 is disposed horizontally widthwise to the printer below the inkjet head 17 with a specific gap therebetween. When the recording paper 10 delivered from the roll paper 9 passes the printing position, the vacuum platen 8 pulls the recording paper 10 to the vacuum platen surface 8*a*. A recording paper vacuum mechanism is disposed to the vacuum platen 8 and printer case 2. The vacuum platen 8 and the recording paper vacuum mechanism (recording medium vacuum mechanism) are described in detail below.

A tension guide 24 that curves down is attached to the back end of the vacuum platen 8. The tension guide 24 is urged upward by a spring force, and the recording paper 10 pulled off the roll paper 9 stored in the roll paper compartment 7 is conveyed through the recording paper transportation path (recording medium transportation path) passed the printing position with a specific amount of tension applied to the recording paper 10 by the tension guide 24.

A rear paper feed roller 25 (recording medium transportation roller) is disposed horizontally widthwise to the printer behind the vacuum platen 8. A rear paper pressure roller 26 of a specific width is pressed with a specific force to the rear paper feed roller 25 with the recording paper 10 therebetween.

A front paper feed roller 27 (front recording medium transportation roller) is disposed to a position at the front of the vacuum platen 8. A front paper pressure roller 28 (front recording medium pressure roller) is pressed from above to the front paper feed roller 27 with the recording paper 10 therebetween. The rear paper feed roller 25 and front paper feed roller 27 are driven by a paper feed motor 29 (recording medium transportation motor) mounted on the printer frame 15. The vacuum platen 8, tension guide 24, rear paper feed roller 25, and front paper feed roller 27 move in conjunction with the access cover 3 when the access cover 3 opens and closes.

Figure 4:
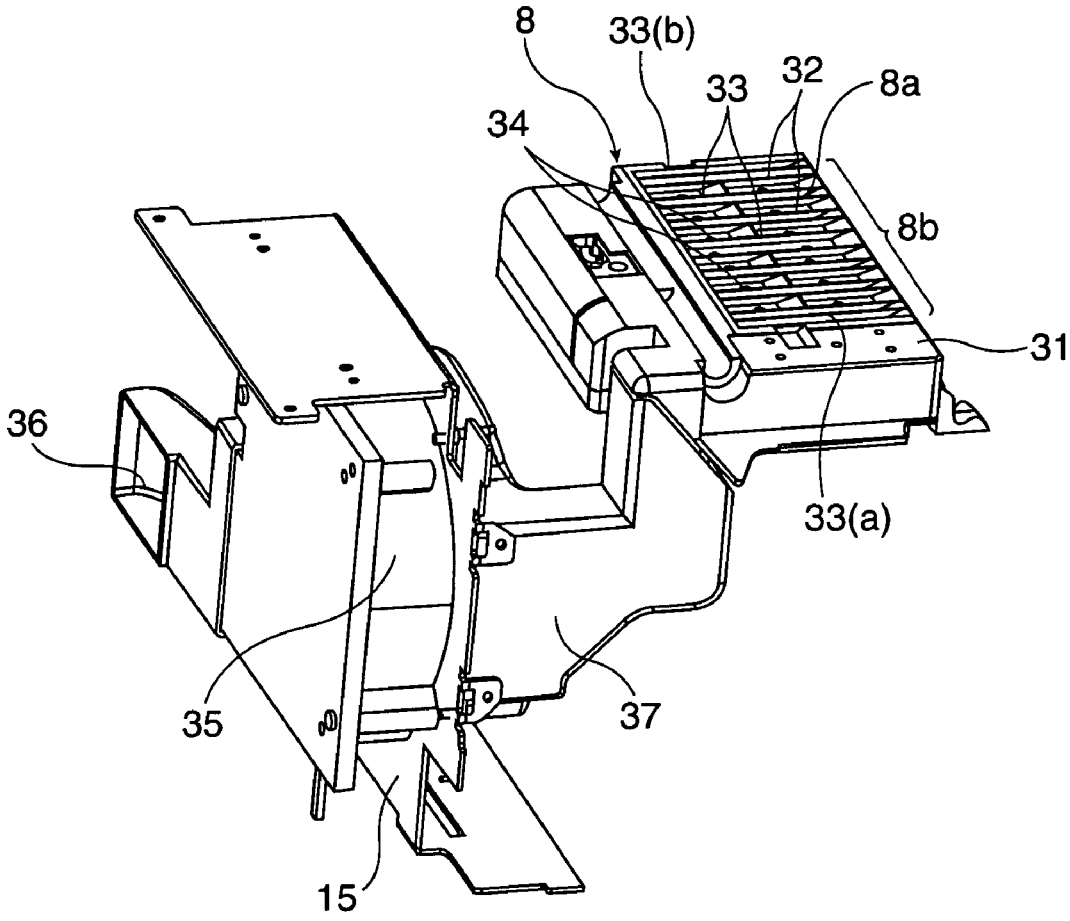
FIG. 4 is a partial oblique view showing the vacuum platen and the recording paper suction mechanism.
Figure 5:
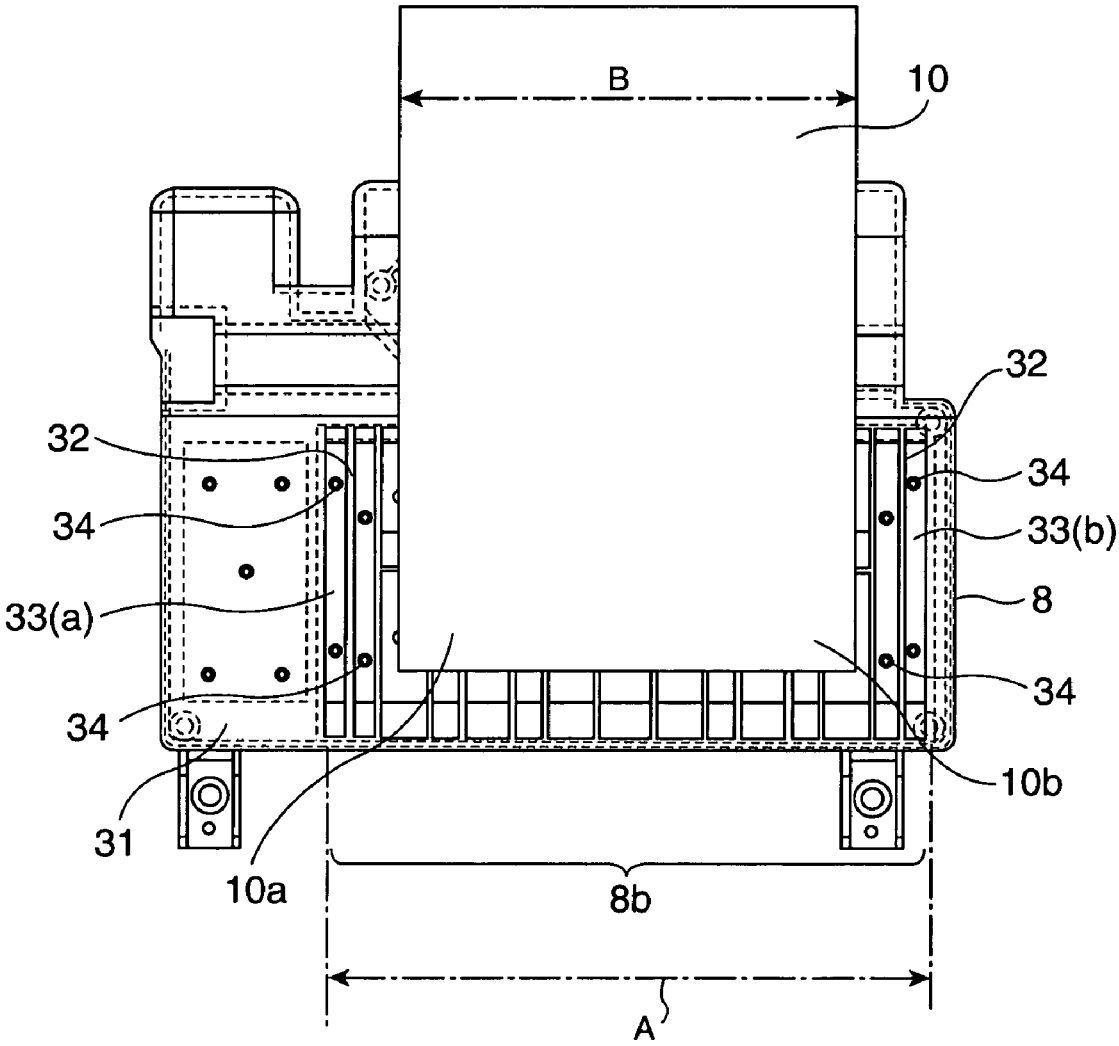

The vacuum platen 8 and recording paper vacuum mechanism are described next with reference to FIG. 4 and FIG. 5. FIG. 4 is a partial oblique view showing the vacuum platen 8 and the recording paper vacuum mechanism. FIG. 5 is a plan view of the vacuum platen 8 when the recording paper 10 passes thereover.

The vacuum platen 8 has a long, flat rectangular shape and is oriented with the long side aligned widthwise to the printer. An ink mist recovery unit 31 is formed in unison with the vacuum platen 8 at one side of the vacuum platen 8. The ink mist recovery unit 31 recovers ink mist that results from the ink droplets discharged from the inkjet head 17. The vacuum platen surface 8*a* of the vacuum platen 8 is divided into a plurality of channel-like chambers 33 by a plurality of longitudinal ribs 32.

The recording paper vacuum mechanism is composed of these plural chambers 33, vacuum holes 34 formed in the bottoms of the plural chambers 33, a vacuum fan 35 that is attached to the back panel of the printer frame 15, and an air duct 37 that communicates with each of the chambers 33 through the vacuum holes 34, and through the vacuum fan 35 with an outlet vent 36 that is formed in the back of the printer case 2.

The vacuum platen 8 and air duct 37 can connect and disconnect. When the access cover 3 opens, the vacuum platen 8 moves forward in conjunction with the access cover 3 and therefore disconnects from the air duct 37. When the access cover 3 closes, the vacuum platen 8 returns to its original position and thus connects to the air duct 37. If the vacuum fan 35 is driven when the vacuum platen 8 and air duct 37 are connected, air is pulled through the vacuum holes 34, thus pulling the recording paper 10 travelling over the vacuum platen surface 8*a* to the platen surface.

The width of the vacuum platen 8 is aligned with the width of the printer, and the top openings of the chambers 33 are the vacuum area 8*b* of the vacuum platen 8. The width A of the vacuum area 8*b* widthwise to the vacuum platen 8 is the width from the left edge of the top opening of the chamber 33(*a*) at the left end of the vacuum platen 8, to the right edge of the top opening of the chamber 33(*b*) at the right end of the vacuum platen 8. The paper width B of the recording paper 10 is the width of the recording paper 10 widthwise to the vacuum platen 8.

During printing the roll paper printer 1 drives the vacuum holes 34 and pulls the recording paper 10 delivered from the roll paper 9 to the vacuum area 8*b* of the vacuum platen 8. The roll paper printer 1 prints by repeating an operation of moving the inkjet head 17 widthwise to the vacuum platen 8 by moving the carriage 20 along the carriage guide shaft 21 while printing, and an operation of conveying the recording paper 10 a specific pitch in the direction perpendicular to the width of the vacuum platen 8 by rotationally driving the rear paper feed roller 25 and front paper feed roller 27.

When the paper width B of the recording paper 10 used for printing is narrower than the width A of the vacuum area 8*b* of the vacuum platen 8, part of the vacuum area 8*b* is exposed beyond the outside of the first and second paper edges 10*a* and 10*b* that determine the width B of the recording paper 10. The suction of air through this exposed area produces an air current around the first and second paper edges 10*a* and 10*b*. This air current propels paper dust and particulate above the first and second paper edges 10*a* and 10*b*. The edges of the recording paper 10 are the cut surfaces of the paper fiber, and paper dust occurs easily. Because this embodiment of the invention has first and second side walls 11 and 12 that hold both sides of the roll paper 9 loaded in the roll paper compartment 7 to prevent play, the sides of the roll paper 9 rub against the first and second side walls 11 and 12 when the recording paper 10 is conveyed and produce paper dust. This paper dust may also be carried with the recording paper 10 from the roll paper compartment 7 to the vacuum platen 8.

As a result, when the width B of the recording paper 10 is narrower than the width A of the vacuum area 8*b* of the vacuum platen 8, driving the roll paper printer 1 is controlled so that the recording paper 10 is conveyed when the ink nozzle area 17*a* of the inkjet head 17 is positioned a specific distance away from the first and second paper edges 10*a* and 10*b* to prevent paper dust and other particulate that is carried from the roll paper compartment 7 to the printing position from being driven airborne and clinging to the ink nozzle area 17*a*.

Control System

Figure 6:
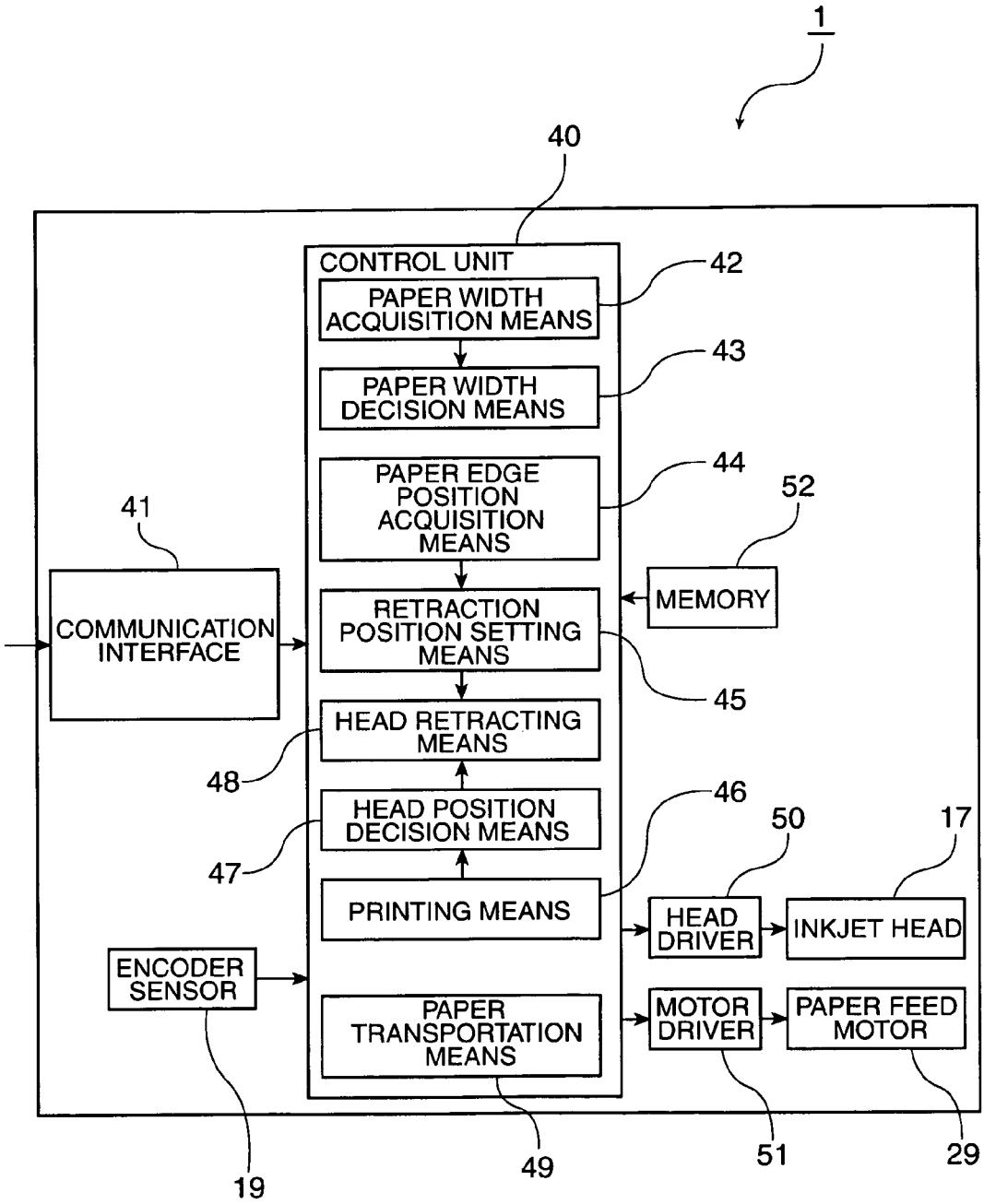
FIG. 6 is a schematic block diagram showing the control system of the roll paper printer.
Figure 7:
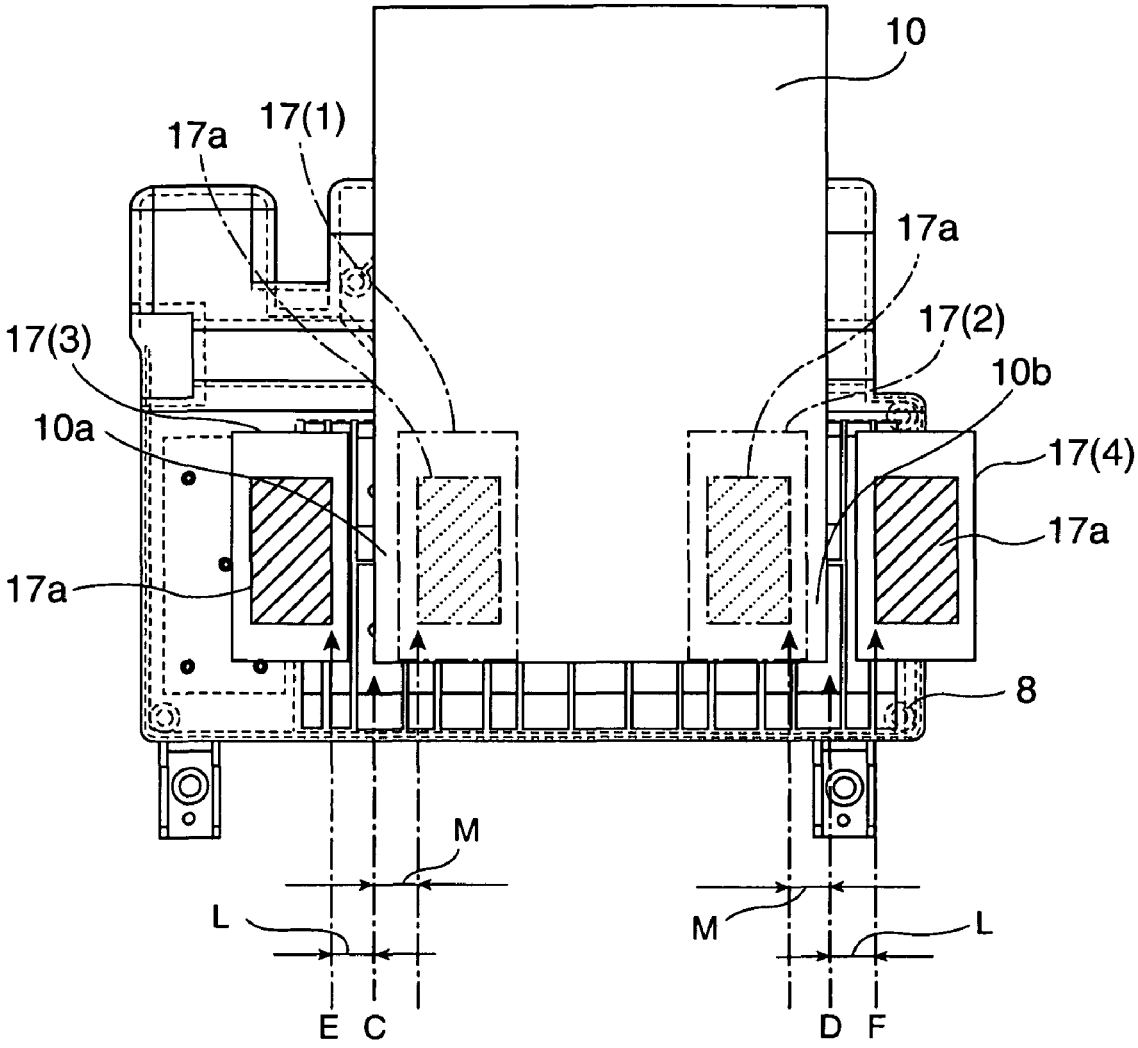
FIG. 7 is a plan view of the vacuum platen describing the first and second retraction positions.

The control system of the roll paper printer 1 is described next with reference to FIG. 6 and FIG. 7. FIG. 6 is a block diagram showing the control system of the roll paper printer 1. FIG. 7 is a plan view of the vacuum platen 8 schematically showing the position of the inkjet head 17 to describe the first and second retraction positions.

The control system of the roll paper printer 1 is constructed around a control unit 40 having a CPU. Print data controlling printing and control commands indicating various control operations are supplied from an external device such as a personal computer through a communication interface 41 to the control unit 40. The control unit 40 includes a paper width acquisition means 42 (recording medium width acquisition control unit), a paper width decision means 43 (recording medium width evaluation means), a paper edge position acquisition means 44 (recording medium edge position acquisition control unit), a retraction position setting means 45 (retraction position setting unit), printing means 46 (printing control unit), head position decision means 47 (head position evaluation unit), head retracting means 48 (head retraction control unit), and paper transportation means 49 (paper transportation control unit).

The inkjet head 17 and paper feed motor 29 are connected to the output side of the control unit 40 through a head driver 50 and a motor driver 51. The encoder sensor 19 and memory 52 are also connected to the control unit 40.

The paper width acquisition means 42 receives control commands from an external device and gets the width B of the recording paper 10 that is contained in the control command. The control commands are sent from a printer driver that is run on a personal computer as the external device, for example, and the recording paper 10 width B that is set by the operator is contained in the control command.

Based on the width B of the recording paper 10 acquired by the paper width acquisition means 42, the paper width decision means 43 determines if the width B of the recording paper 10 is greater than or equal to the width A of the vacuum area 8*b*.

If the width B of the recording paper 10 is less than the width A of the vacuum area 8*b*, based on the width B of the recording paper 10 the paper edge position acquisition means 44 acquires the position of the first paper edge 10*a* of the recording paper 10 (first paper edge 10*a* of the recording medium) and the position of the second paper edge 10*b* (second paper edge 10*b* of the recording medium) as the first edge position C (first recording medium edge position) and the second edge position D (second recording medium edge position), respectively.

Because the position where the recording paper 10 passes over the vacuum platen surface 8*a* of the vacuum platen 8 is predetermined according to the width B of the recording paper 10, the first and second paper edge positions C and D are prestored in memory 52 for each width B of the recording paper 10. The paper edge position acquisition means 44 can therefore get the first and second paper edge positions C and D from memory 52.

When the width B of the recording paper 10 is less than the width A of the vacuum area 8*b*, the retraction position setting means 45 sets the first and second retraction positions E and F used as the references for moving the inkjet head 17 during paper transportation. As shown in FIG. 7, the first and second retraction positions E and F are set a first distance L away from the first and second paper edge positions C and D of the recording paper 10.

This first distance L is determined based on the flight distance of the paper dust and other particulate that is propelled by the air current produced by the suction of the vacuum platen 8. In this embodiment of the invention the first distance L is 5 mm.

The retraction position setting means 45 can set the first and second retraction positions E and F based on the first and second paper edge positions C and D acquired by the paper edge position acquisition means 44. Alternatively, if the first and second retraction positions E and F are prestored in memory 52 as information linked to the width B of the recording paper 10, the retraction position setting means 45 can get the first and second retraction positions E and F from memory 52.

Based on the print data received from an external device, the printing means 46 prints on the recording paper 10 while moving the inkjet head widthwise to the vacuum platen 8.

If the width B of the recording paper 10 is less than the width A of the vacuum area 8*b*, the head position decision means 47 acquires the end-of-printing position of the inkjet head 17 relative to the width of the vacuum platen 8 when printing by the printing means 46 stops.

More specifically, the head position decision means 47 acquires the end-of-printing position of the inkjet head 17 based on output from the encoder sensor 19. The head position decision means 47 also determines if the ink nozzle area 17*a* of the inkjet head 17 at the end-of-printing position is separated second distance M or more to the inside of the recording paper 10 from the first and second paper edge positions C and D.

This second distance M is determined based on the flight distance of the paper dust and other particulate that is propelled by the air current produced by the suction of the vacuum platen 8. Like the first distance L, the second distance M in this embodiment of the invention is 5 mm.

The left and right inkjet head positions 17(1) and 17(2) denoted by the dot-dash lines in FIG. 7 are positions where the ink nozzle area 17*a* is separated second distance M from the first and second paper edge positions C and D, respectively. Therefore, if printing stops between the left and right inkjet head positions 17(1) and 17(2) denoted by the dot-dash lines, the ink nozzle area 17*a* of the inkjet head 17 is determined to be second distance M or more from the first and second paper edge positions C and D. However, if printing stops with the inkjet head 17 to the outside of the left and right inkjet head positions 17(1) and 17(2) denoted by the dot-dash lines, the ink nozzle area 17*a* of the inkjet head 17 is determined to not be positioned second distance M or more from the first and second paper edge positions C and D.

Note that if the width B of the recording paper 10 is greater than or equal to the width A of the vacuum area 8*b*, the head position decision means 47 does not execute the operation of acquiring the end-of-printing position and the operation of determining if the ink nozzle area 17*a* of the inkjet head 17 is separated second distance M or more from the first and second paper edge positions C and D.

If the width B of the recording paper 10 is less than the width A of the vacuum area 8*b*, and the ink nozzle area 17*a* of the inkjet head 17 in the end-of-printing position is not separated second distance M or more from the first and second paper edge positions C and D, the head retracting means 48 moves the inkjet head 17 so that the ink nozzle area 17*a* of the inkjet head 17 is positioned on the outside of the first and second retraction positions E and F. More specifically, if printing stops with the inkjet head 17 on the outside of the left and right inkjet head positions 17(1) and 17(2) denoted by the dot-dash lines in FIG. 7, the head retracting means 48 moves the inkjet head 17 to one of the left and right inkjet head positions 17(3) and 17(4) denoted by the solid lines in the figure.

The head retracting means 48 moves the inkjet head 17 to the first or second retraction positions E or F located forward in the direction the inkjet head 17 was moving during printing by the printing means 46. More specifically, if the inkjet head 17 is moving from right to left while the printing means 46 is printing, the head retracting means 48 continues moving the inkjet head 17 to the left to the inkjet head position 17(3) on the first retraction position E side. If the inkjet head 17 was moving from left to right, the inkjet head 17 continues moving to the right to the inkjet head position 17(4) on the second retraction position F side.

If the width B of the recording paper 10 is determined to be narrower than the width A of the vacuum area 8*b*, and the ink nozzle area 17*a* of the inkjet head 17 in the end-of-printing position is determined to be separated second distance M or more from the first and second paper edge positions C and D, the inkjet head 17 is not moved and is held in the end-of-printing position. More specifically, if printing stops with the inkjet head 17 between the left and right inkjet head positions 17(1) and 17(2) denoted by the dot-dash lines in FIG. 7, the inkjet head 17 is held at the position where printing stopped.

If the width B of the recording paper 10 is greater than or equal to width A of the vacuum area 8*b*, the head retracting means 48 does not move the inkjet head 17. The inkjet head 17 is not exposed to paper dust at this position and there is therefore no need to move the inkjet head 17 to a retraction position. The control unit 40 can therefore control the carriage 20 by logical seeking control to print while moving the carriage 20 the shortest distance.

When the inkjet head 17 moves and the ink nozzle area 17*a* is positioned outside of the first or second retraction position E or F, the paper transportation means 49 conveys the recording paper 10 a specific pitch.

If the width B of the recording paper 10 is determined to be narrower than the width A of the vacuum area 8*b* and the ink nozzle area 17*a* of the inkjet head 17 in the end-of-printing position is determined to be separated second distance M or more from the first and second paper edge positions C and D, and if the width B of the recording paper 10 is greater than or equal to the width A of the vacuum area 8*b*, the paper transportation means 49 conveys the recording paper 10 when printing by the printing means 46 ends.

Printing Operation of the Roll Paper Printer

Figure 8:
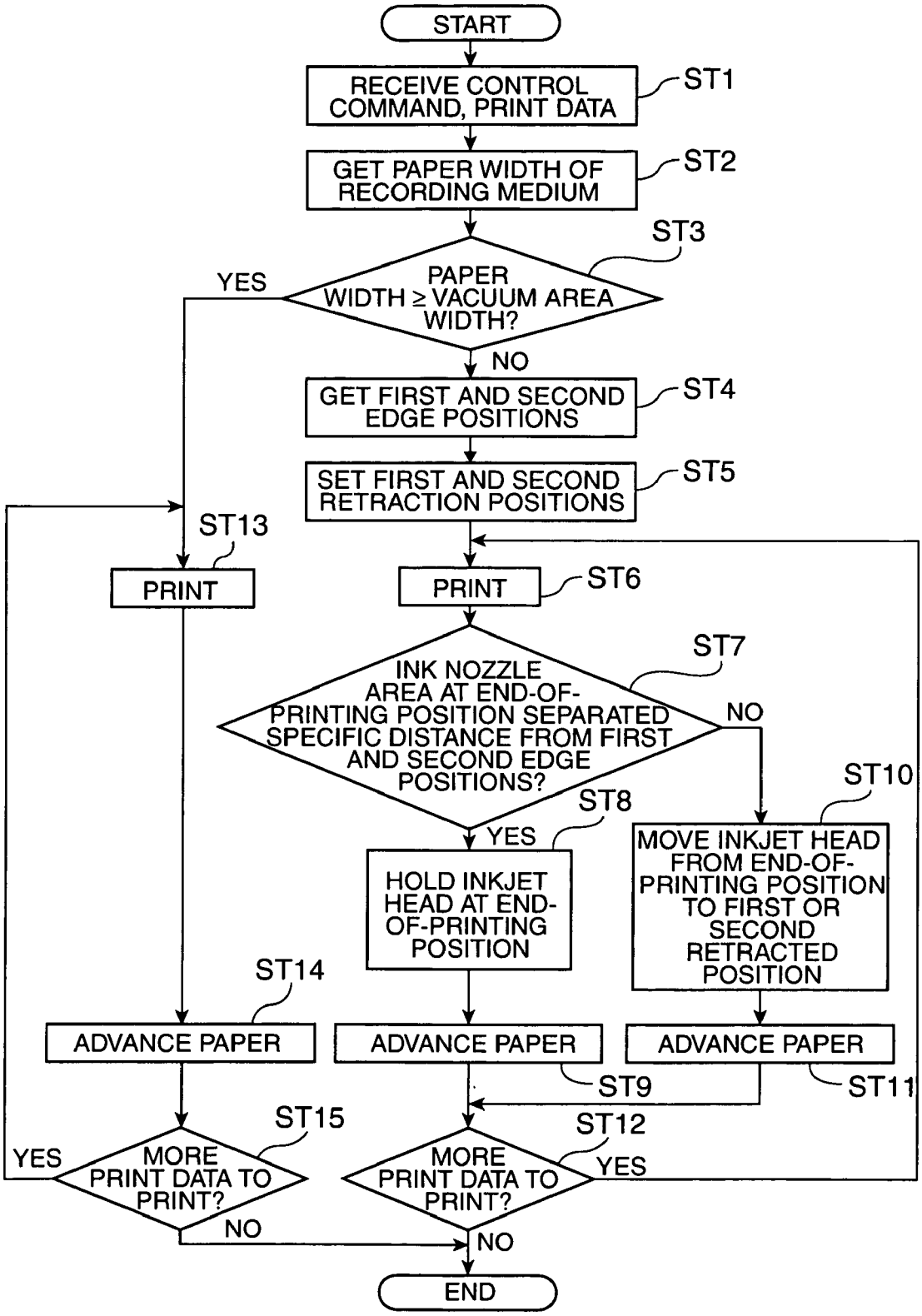
FIG. 8 is a flow chart of the printing operation of the roll paper printer.

FIG. 8 is a flow chart describing the printing operation of the roll paper printer 1.

When the roll paper printer 1 receives print data for printing and control commands from an external device (step ST1), the paper width acquisition means 42 acquires the width B of the recording paper 10 to be used for printing from the control command (step ST2). When the width B of the recording paper 10 is acquired, the paper width decision means 43 determines if the width B of the recording paper 10 is greater than or equal to width A of the vacuum area 8*b* of the vacuum platen 8 (step ST3).

If in step ST3 the width A of the vacuum area 8*b* is narrower than the width B of the recording paper 10, the paper edge position acquisition means 44 acquires the first and second paper edge positions C and D based on width B. The retraction position setting means 45 then sets the first and second retraction positions E and F (steps ST4, ST5).

The printing means 46 then prints on the recording paper 10 while moving the inkjet head 17 across the width of the vacuum platen 8 (step ST6). The head position decision means 47 then acquires the end-of-printing position of the inkjet head 17, and determines if the ink nozzle area 17*a* of the inkjet head 17 in the end-of-printing position is separated second distance M or more from the first and second paper edge positions C and D (step ST7).

The head position decision means 47 determines in step ST7 that ink nozzle area 17*a* is separated second distance M or more from the first and second paper edge positions C and D, the inkjet head 17 is held in the end-of-printing position (step ST8) and the paper transportation means 49 advances the recording paper 10 (step ST9).

However, if the head position decision means 47 determines in step ST7 that ink nozzle area 17*a* is not separated second distance M or more from the first and second paper edge positions C and D, the head retracting means 48 moves the inkjet head 17 to the first or second retraction position E or F positioned forward in the direction the inkjet head 17 was moving in step ST5, and positions the ink nozzle area 17*a* of the inkjet head 17 outside of the first or second retraction position E or F (step ST10). The paper transportation means 49 then advances the recording paper 10 (step ST11).

When the recording paper 10 is conveyed in step ST9 or step ST11, whether there is any print data that has not been printed is determined (step ST12), and steps ST6 to ST11 repeat until there is no more print data to print.

If in step ST3 the width B of the recording paper 10 is greater than or equal to the width A of the vacuum area 8*b*, the recording paper 10 passing over the printing position covers the entire width A of the vacuum area 8*b*, and an air current produced by the suction from the vacuum platen 8 does not occur at the first and second paper edge positions C and D of the recording paper 10. It is therefore not necessary to retract the inkjet head 17 from the first and second paper edge positions C and D, and the recording paper 10 is conveyed by the paper transportation means 49 after printing by the printing means 46 (steps ST13 and ST14).

When the recording paper 10 is conveyed in step ST14, whether there is an print data that has not been printed is determined (step ST15), and steps ST13 and ST14 repeat until there is no more print data to print.

Effect of the Invention

This embodiment of the invention moves the inkjet head 17 that prints to the recording paper 10 while moving widthwise to the vacuum platen 8 so that the ink nozzle area 17*a* is positioned on the outside of first and second retraction positions E and F that are separated a first distance L from the first and second paper edge positions C and D of the recording paper 10. The recording paper 10 is conveyed after thus moving the inkjet head 17. As a result, because the ink nozzle area 17*a* of the inkjet head 17 does not stop above the first and second paper edge positions C and D of the recording paper 10, the clinging of paper dust and particulate to the ink nozzle area 17*a* can be suppressed or avoided even when paper dust and particulate can be easily propelled and dispersed by the air current produced by the suction of the vacuum platen 8 at the paper edge positions C and D.

Furthermore, because the ink nozzle area 17*a* is positioned in an area separated from the paper edge positions C and D of the recording paper 10 when the paper is conveyed, clinging of paper dust and particulate to the ink nozzle area 17*a* can be suppressed or avoided even if paper dust or particulate that is conveyed with the recording paper 10 is propelled and dispersed in the air. As a result, print defects, including content not printing, can be avoided because ink droplets are not prevented from being discharged normally as a result of ink nozzles becoming clogged by paper dust or other particulate dust.

If the ink nozzle area 17*a* of the inkjet head 17 in the end-of-printing position is separated second distance M or more from the first and second retraction positions E and F when printing stops, clinging of paper dust and other dust particulate to the ink nozzle area 17*a* is suppressed or prevented by not moving and holding the inkjet head 17 where it was when printing stopped. The printing time can therefore be shortened because the inkjet head is not moved.

When the width B of the recording paper 10 used for printing is greater than or equal to the width A of the vacuum area 8*b* of the vacuum platen 8, the printer case 2 according to this embodiment of the invention simply repeats printing by the printing means 46 and advancing the recording paper 10 by means of the paper transportation means 49. More specifically, when the entire width A of the vacuum area 8*b* of the vacuum platen 8 is covered by the recording paper 10 and an air current is not produced by the suction of the vacuum platen 8, the printing time can be shortened because printing proceeds without operating the head retracting means 48.

Other Embodiments

The first and second retraction positions E and F are set based on the width B of the recording paper 10 used for printing in the embodiment described above, but the first and second retraction positions E and F can be preset irrespective of the width B of the recording paper 10 used for printing. For example, to prevent the effects of air current produced by vacuum suction, the first and second retraction positions E and F can be set to positions separated at least first distance L from the vacuum area 8*b* of the vacuum platen 8. Further alternatively, the first and second retraction positions E and F can be set referenced to the maximum width of the roll paper 9 that can be stored in the roll paper compartment 7.

When the end-of-printing position is separated second distance M or more from the first and second paper edge positions C and D, the foregoing embodiment holds the inkjet head 17 at the end-of-printing position without changing the position. Alternatively, however, driving the inkjet head 17 could be controlled to move to a position at the first or second retraction position E or F side. Controlling driving the inkjet head 17 in this way does not require a head position decision means 47, and print control of the roll paper printer 1 can therefore be simplified.

The head retracting means 48 in the foregoing embodiment moves the inkjet head 17 to the first or second retraction position E or F that is positioned forward in the direction the inkjet head 17 was moving during printing by the printing means 46. Alternatively, however, the inkjet head 17 may be moved to the first or second retraction position E or F that is closest to the end-of-printing position based on the end-of-printing position acquired by the head position decision means 47. This method shortens the distance and the time required to move the inkjet head 17 to the first or second retraction position E or F, and can therefore shorten the printing time.

A paper width detector for acquiring the width B of the recording paper 10 may also be used. A paper width detector has a photosensor disposed to the carriage 20, for example, and can acquire the width B of the recording paper 10 based on the reflection of light from the recording paper 10 that is detected while the carriage 20 moves widthwise to the vacuum platen 8. If a paper width detector is used, the paper width detector is operated before printing starts to get the width B of the recording paper 10.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printing control method for a serial inkjet printer, comprising:

a recording medium width determination step of determining if a width of a recording medium is greater than or equal to a width of a vacuum area widthwise to a vacuum platen that has the vacuum area for pulling the recording medium thereto;

a printing step of printing to the recording medium while moving an inkjet head widthwise to the vacuum platen;

a head retracting step of moving the inkjet head so that an ink nozzle area of the inkjet head is positioned outside of a first retraction position or a second retraction position, which are respectively located a first distance outside of the recording medium from a first edge part or a second edge part of the recording medium widthwise to the vacuum platen; and a recording medium transportation step that conveys the recording medium in a direction perpendicular to a width of the vacuum platen;

wherein the head retracting step is performed after the printing step and prior to the recording medium transportation step when the width of the recording medium is narrower than the width of the vacuum area; and wherein the head retracting step is not performed when the width of the recording medium is greater than or equal to the width of the vacuum area.

2. The printing control method for a serial inkjet printer described in claim 1, further comprising:

a retraction position setting step of setting any of the first retraction position and the second retraction position based on the width of the recording medium widthwise to the vacuum platen.

3. The printing control method for a serial inkjet printer described in claim 2, further comprising:

a recording medium width acquisition step of receiving a control command for printing from an external device, and acquiring the width of the recording medium contained in the control command.

4. The printing control method for a serial inkjet printer described in claim 2, further comprising:

a recording medium width acquisition step of acquiring the width of the recording medium by means of a paper width detector.

5. The printing control method for a serial inkjet printer described in claim 1, wherein:

the head retracting step moves the inkjet head outside of the first retraction position or the second retraction position that is positioned in the direction the inkjet head was moving in the printing step.

6. The printing control method for a serial inkjet printer described in claim 1, further comprising:

a recording medium edge position acquisition step of acquiring the positions of the first edge part and the second edge part of the recording medium widthwise to the vacuum platen before the printing step based on the width of the recording medium;

a head position determination step of acquiring an end-of-printing position where the inkjet head is positioned widthwise to the vacuum platen after the printing step, and determining if the ink nozzle area of the inkjet head in the end-of-printing position is located a second distance or more inside of the recording medium from the first edge part or the second edge part;

the head retracting step holding without moving the inkjet head at the end-of-printing position if the ink nozzle area is located the second distance or more inside of the recording medium from the first edge part or the second edge part.

7. A serial inkjet printer comprising:

a vacuum platen that has a vacuum area for pulling a recording medium thereto;

an inkjet head that moves across the vacuum area of the vacuum platen for printing to the recording medium; and a control unit that determines if a width of the recording medium is greater than or equal to a width of the vacuum area widthwise to the vacuum platen, and that controls moving the ink jet head, when after printing by the inkjet head, the control unit moves the inkjet head so that an ink nozzle area of the inkjet head is positioned outside of a first retraction position located a first distance out-side of a first edge part of the recording medium or a second retraction position located the first distance outside of the recording medium from a second edge part of the recording medium when the width of the recording medium is narrower than the width of the vacuum area, and after moving the inkjet head, the control unit controls conveying the recording medium.

8. The serial inkjet printer described in claim 7, further comprising:

a retraction position setting unit that sets any of the first retraction position and the second retraction position based on the width of the recording medium widthwise to the vacuum platen.

9. The serial inkjet printer described in claim 7, wherein:

the control unit moves the inkjet head to the first retraction position or the second retraction position that is positioned in the direction the inkjet head was moving while printing.

10. The serial inkjet printer described in claim 7, further comprising:

a recording medium edge position acquisition unit that acquires the positions of the first edge part and the second edge part of the recording medium widthwise to the vacuum platen based on the width of the recording medium;

the control unit acquiring an end-of-printing position where the inkjet head is positioned widthwise to the vacuum platen when printing ends, determining if the ink nozzle area of the inkjet head in the end-of-printing position is separated a second distance or more inside of the recording medium from the first edge part or the second edge part of the recording medium, and holding without moving the inkjet head at the end-of-printing position if the ink nozzle area is separated the second distance or more from the first edge part or the second edge part.

11. The serial inkjet printer described in claim 7, wherein:

the control unit that does not move the inkjet head if the width of the recording medium is greater than or equal to the width of the vacuum area.

12. The serial inkjet printer described in claim 7, further comprising:

a recording medium width acquisition unit that receives a control command from an external device, and acquires the width of the recording medium contained in the control command.

13. The serial inkjet printer described in claim 7, further comprising:

a recording medium width detector that acquires the width of the recording medium.

* * * * *